US010494138B1

(12) United States Patent
Velliquette et al.

(10) Patent No.: US 10,494,138 B1
(45) Date of Patent: Dec. 3, 2019

(54) BRACE ASSEMBLY FOR A CONTAINER

(71) Applicant: Green Bay Packaging, Inc., Green Bay, WI (US)

(72) Inventors: Jeremy Velliquette, Gibsonburg, OH (US); Andrew Capogrosso, Fremont, OH (US); Brian Fox, Tiffin, OH (US)

(73) Assignee: Green Bay Packaging, Inc., Green Bay, WI (US)

( * ) Notice: Subject to any disclaimer, the term of this patent is extended or adjusted under 35 U.S.C. 154(b) by 0 days.

(21) Appl. No.: 15/876,533

(22) Filed: Jan. 22, 2018

Related U.S. Application Data

(60) Provisional application No. 62/449,777, filed on Jan. 24, 2017.

(51) Int. Cl.
*B65D 5/10* (2006.01)
*B65D 5/50* (2006.01)
*B65D 5/44* (2006.01)

(52) U.S. Cl.
CPC ..... *B65D 5/446* (2013.01); *B65D 5/5095* (2013.01); *B65D 5/5033* (2013.01)

(58) Field of Classification Search
CPC ..... B65D 5/446; B65D 5/5095; B65D 5/445; B65D 5/50; B65D 85/64; B65D 5/5213
USPC ..... 229/199.1, 199, 120.37, 919; 206/320, 206/592; 220/651, 652, 653, 639, 640
See application file for complete search history.

(56) References Cited

U.S. PATENT DOCUMENTS 1,841,025 A * 1/1932 Gomes ..... B65D 5/5095 206/320
2,969,170 A 1/1961 Waldorf
3,913,736 A * 10/1975 Brennan ..... D06F 39/001 206/320
3,938,661 A * 2/1976 Carmody ..... B65D 81/113 206/523
4,230,227 A 10/1980 Kowall et al.
5,769,309 A * 6/1998 Beneroff ..... B65D 5/0281 229/120.04
6,749,108 B2 6/2004 Naughton et al.
6,968,947 B2 * 11/2005 Johnson ..... B65B 9/073 206/423
7,413,111 B2 8/2008 Quaintance et al.
9,670,611 B2 * 6/2017 Senn ..... B65D 5/02
2012/0138618 A1 * 6/2012 Senn ..... B65D 5/445 220/652

* cited by examiner

*Primary Examiner* — Christopher R Demeree
(74) *Attorney, Agent, or Firm* — Boyle Fredrickson, S.C.

(57) ABSTRACT

A container for an article includes a series of walls including a top wall that cooperate to define an interior of the container. A brace assembly is positioned toward an upper end defined by the interior of the container, and includes a brace member that is positioned below the top wall of the container and that defines opposite ends, each of which is located adjacent one of a pair of opposite sidewalls of the container. The brace assembly includes a carrier, which may be formed of a series of corrugated panels, and the brace member may be secured to a hinged brace member mounting panel such that the brace member is suspended above an upper surface of an article within the container interior and below the top wall of the container.

9 Claims, 3 Drawing Sheets

BRACE ASSEMBLY FOR A CONTAINER

CROSS-REFERENCE TO RELATED APPLICATION

This application claims priority to U.S. Provisional Application No. 62/449,777, filed on Jan. 24, 2017, the entire contents of which are hereby expressly incorporated by reference into this application.

BACKGROUND OF THE INVENTION

1. Field of the Invention

The present invention relates to a brace assembly, such as a lateral brace assembly, for a container to improve the rigidity of the container during handling and increase protection of the product disposed within the container

2. Background of the Invention

Containers are regularly used to store and ship products. In most instances, the containers are rectangular, regardless of the shape of the product within the interior of the container. As a result, the interior of the container includes a space occupied by the product (the product space) and one or more void areas or spaces that are not occupied by the product (the non-product space), which result from the shape of the product not matching the shape of the container. Without the assistance of a bracing element, the container has reduced rigidity in the non-product space portion of the container due to the surface(s) of the product being spaced from the container walls. This can present problems during handling of the container, which sometimes involves the opposite sidewalls of the container being engaged by material handling equipment in a clamping-type manner.

Therefore, there is need in the art for a brace assembly, such as a lateral brace assembly, which extends across the non-product space of the container. The lateral brace assembly provides a support to increase the rigidity of the sidewalls of the container adjacent the non-product space. In turn, the container is better able to protect the product disposed within the container during shipping and handling.

SUMMARY OF THE INVENTION

The invention is directed to a brace assembly, such as a lateral brace assembly, for a container to improve the rigidity of the container during handling and increase protection of the product disposed within the container.

According to an embodiment of the invention, a container may be formed to define a product space and a non-product space, and may include a brace assembly, which representatively may be a lateral brace assembly. The lateral brace assembly includes a carrier that overlies the product when the product is received within the interior of the container. A lateral brace member is secured to the carrier. The lateral brace member is located within and spans across the non-product space within the interior of the container, and is configured such that each of a pair of ends defined by the lateral brace member is located adjacent one of the side walls of the container. The carrier and lateral brace member are configured such that the lateral brace member is located above an upper surface of the product and below a top wall of the container.

The carrier may be in the form of a generally planar top member and a brace member mounting panel that is movably secured to the planar top member. Representatively, the generally planar top member and the brace member mounting panel may be formed integrally with each other. In one embodiment, the top member and the brace member mounting panel may be formed from a blank of material, such as corrugated board. The brace member mounting panel may define an upper end that has a hinge connection to the top member, such that the brace member mounting panel is pivotable relative to the top member. The lateral brace member is secured to the brace member mounting panel at a location spaced from the hinge connection such that, when the brace member mounting panel is pivoted downwardly, the lateral brace member is spaced vertically below the top member.

The lateral brace assembly may also include a pair of end brace members located one on either side of the lateral brace member, such that the lateral brace member is positioned at a location intermediate the end brace members. The end brace members and the lateral brace member are generally parallel to each other. Representatively, the end brace members span between opposite pairs of corners of the container. The end brace members may be supported from below by vertical corner reinforcing members, which are positioned between the corners of the container and adjacent corners defined by the product. The end brace members may be secured one to each of a pair of opposite end areas defined by the carrier.

The invention also contemplates a method of laterally bracing or reinforcing a void or empty space within the interior of a container, substantially in accordance with the foregoing summary.

These and other aspects and objects of the present invention will be better appreciated and understood when considered in conjunction with the following description and the accompanying drawings. It should be understood, however, that the following description, while indicating representative embodiments of the present invention, is given by way of illustration and not limitation. Many changes and modifications may be made within the scope of the present invention without departing from the spirit thereof, and the invention includes all such modifications.

BRIEF DESCRIPTION OF THE FIGURES

A clear conception of the advantages and features constituting the present invention will become more readily apparent by referring to the exemplary, and therefore non-limiting, embodiments illustrated in the drawings accompanying and forming a part of this specification, wherein like reference numerals designate the same elements in the several views.

In the drawings:

FIG. 1 is a perspective view, with portions broken away for clarity, showing a container and a lateral brace assembly, according to an embodiment of the invention, for use in packaging a product or item, such as an appliance or the like;

DETAILED DESCRIPTION

The present invention and the various features and advantageous details thereof are explained more fully with reference to the non-limiting embodiments described in detail in the following description.

Figure 1:
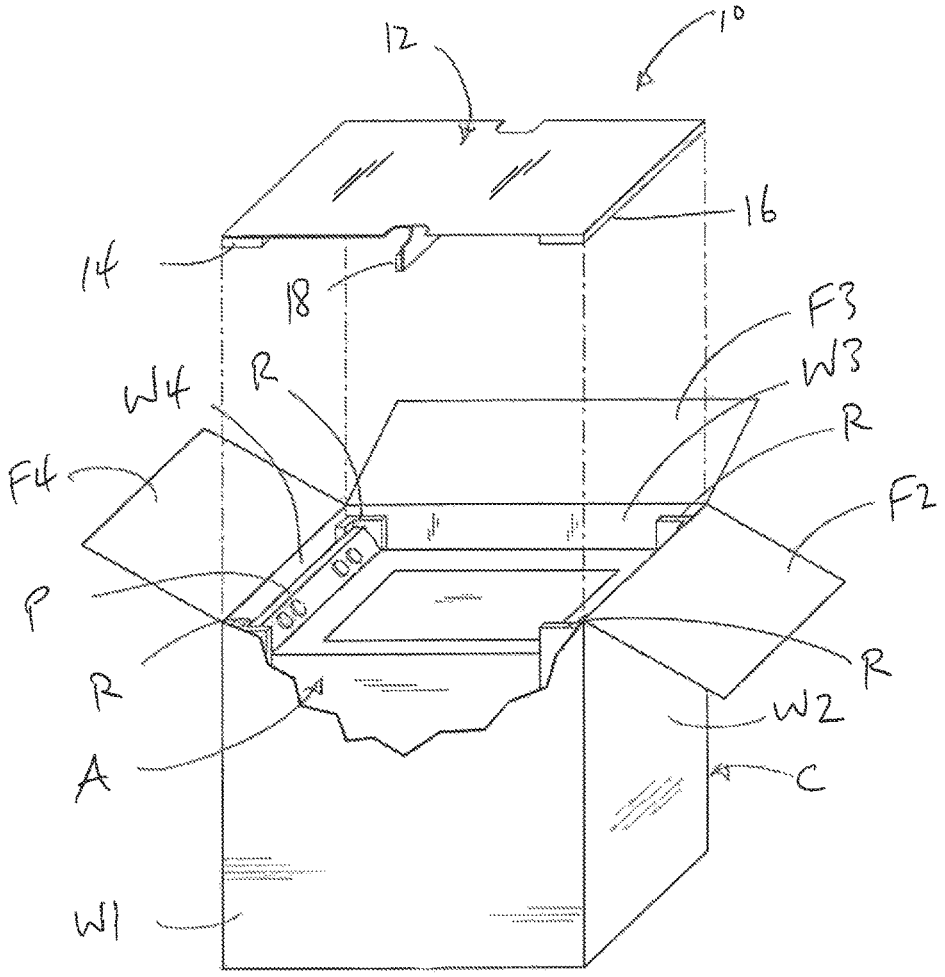

Referring to FIG. 1, a container C is illustrated for use in packaging and shipping a product, item or article such as, but not limited to, an appliance A. In the illustrated embodiment, the appliance A may be in the form of a washing machine or the like, although it is understood that container C may be used to package any article or object as desired. As is relevant for the purposes of the present invention, the appliance A is configured so that there is an empty volume or space in the upper region of the container C above the top of the appliance A and below the top wall of the container C.

Representatively, the container C may be in the form of a box formed of any suitable material such as, but not limited to, corrugated board. In a manner as is known, the container C includes a series of sidewalls, which are illustrated at W1, W2, W3 and W4. A series of top flaps F (not shown), F2, F3 and F4 extend from the top edges of sidewalls W1, W2, W3 and W4, respectively, again in a manner as is known. The top flaps F1, F2, F3 and F4 are folded onto each other to enclose the top end of the container C and collectively form the top wall of the container C.

Also in a manner as is known, a series of vertical corner reinforcement members R are positioned between the corners of the appliance A and the corners of the container C. Representatively, the corner reinforcement members R may have a generally L-shaped cross-section, so that the legs of the corner reinforcement members R are located between the corners of the container C and each adjacent corner of the appliance A, and provide a buffer space between the sidewalls W1, W2, W3 and W4 and the respective adjacent, facing sidewalls of the appliance A. Again, however, it is understood that the cushioning or reinforcement structure between the corners of the appliance A and the corners of the container C may have any suitable configuration or construction as desired.

As noted previously, there is an empty volume or space above the appliance A and below the top wall of the container C as defined by the container top flaps F1, F2, F3 and F4. Representatively, in the case of appliance A being in the form of a washing machine having a control panel P along one of its edges that extends to a height greater than that of the remainder of the washing machine, the empty volume or space is defined by the portion of the internal volume of the container C located forwardly of the control panel P and above the loading area of the washing machine. It is understood, however, that an empty volume or space may be defined between the surfaces of the packaged article, such as appliance A, and the surfaces of the container sidewalls W1, W2, W3 and W4 due to any irregularity or nonconformity between the shape of the internal volume of the container C and the exterior shape of the article, such as appliance A. The empty volume or space within the interior of the container C thus presents an unbraced or unsupported area above the appliance A and below the top wall of the container C as defined by the container top flaps F1, F2, F3 and F4. This can present issues, for example, during shipping and handling when the container C is subjected to lateral forces such as, but not limited to, clamping-type lateral forces that can be applied by material handling equipment.

In accordance with the present invention, a brace assembly 10 is positioned at the upper portion of the interior defined by container C. The brace assembly 10 is configured to reinforce the upper regions of the container C to both protect the surfaces of the appliance A and to provide lateral load-bearing structure at the top end of the container C.

The brace assembly 10 generally includes a carrier 12 and a series of lateral reinforcing members that may be secured to the carrier 12, in a manner to be explained. The reinforcing members include a pair of end reinforcing members 14, 16 and an intermediate reinforcing member 18 located therebetween. Representatively, the reinforcing members 14, 16, 18 may be formed of a material such as wood, which is relatively strong in compression. It is understood, however, that any other relatively rigid reinforcing material, such as metal or plastic, may be employed.

End reinforcing member 14 is configured to rest on and span between a pair of the vertical reinforcing members R at two of the corners of container C. Similarly, end reinforcing member 16 is configured to rest on and span between the opposite pair of vertical reinforcing members R. The end reinforcing members 14, 16 have a length that is only slightly shorter than the width of the interior of the volume of container C, so as to be capable of absorbing any lateral forces applied to the container sidewalls without crushing the reinforcing members R. The intermediate reinforcing member 18 has a similar length to that of end reinforcing members 14, 16.

The intermediate reinforcing member 18 is configured so as to be positioned below the end reinforcing members 14, 16 and above the top surface of the article, such as appliance A. In this manner, the intermediate reinforcing member 18 is located within and spans across the empty volume or space within the interior of container C below the top wall of the container C and above the area of the article, such as appliance A, located forwardly of the control panel P.

Figure 3:
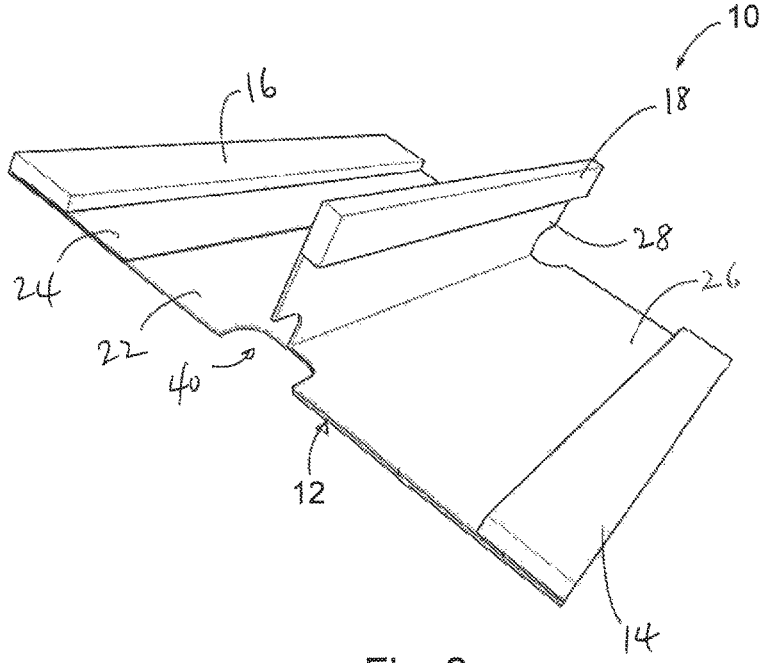
FIG. 3 is an inverted isometric view of the lateral brace assembly of FIGS. 1 and 2.
Figure 4:
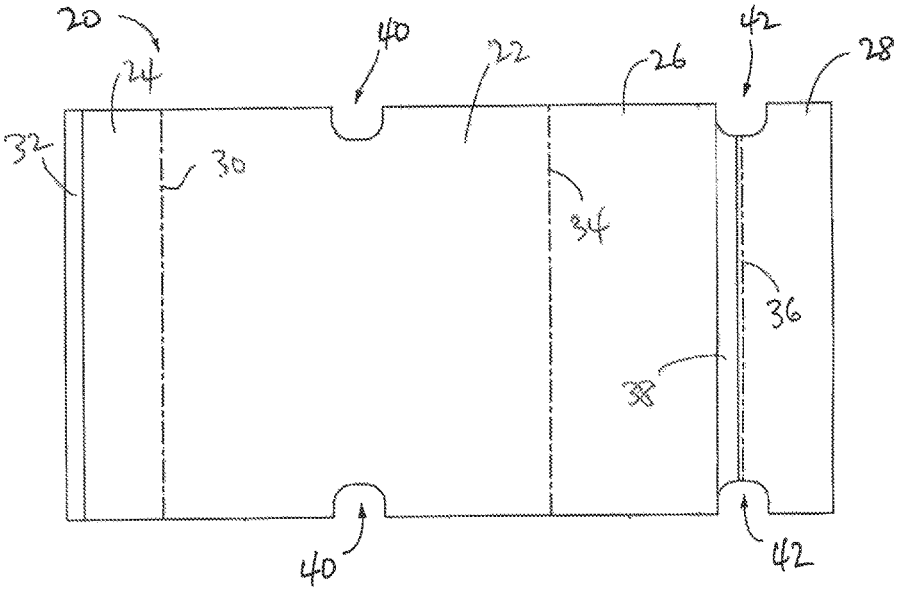
FIG. 4 is a plan view of a blank for use in constructing the lateral brace assembly as shown in FIGS. 1, 2 and 3.

FIGS. 3 and 4 illustrate a representative embodiment of the lateral brace assembly 10 in accordance with the present invention. As noted above, lateral brace assembly 10 consists of carrier 12 to which the brace members 14, 16, 18 may be secured. In the illustrated embodiment, the carrier 12 is formed from a carrier blank, shown at 20 in FIG. 4.

In the illustrated embodiment, the carrier blank 20 includes a central section or panel 22, a first end panel 24, a second end panel 26, and a brace member mounting panel 28. A fold or crease line 30 is located between the central panel 22 and the first end panel 24. A strip of adhesive 30 is provided at the outer end of the first end panel 24.

A fold or crease line 34 is located between the second end panel 26 and the central panel 22, and a fold or crease line 36 is located between second end panel 26 and brace member mounting panel 28. A strip of adhesive 38 is provided at the outer end of second end panel 26 adjacent fold or crease line 36.

A pair of cut-outs or notches 40 are formed in the side edges of central panel 22. A similarly formed pair of cut-outs or notches 42 are formed in an inner portion of the side edges of brace member mounting panel 28 and an outer portion of the side edges of second end panel 26. The fold or crease line 36 is located at the centers of the cut-outs or notches 42.

In assembly, carrier 12 is constructed by folding first end panel 24 inwardly at fold or crease line 30 and securing adhesive strip 32 to the underside of central panel 22. Likewise, second end panel 26 is folded inwardly at fold or crease line 34 and adhesive strip 38 is secured to the underside of central panel 22. First end panel 24 and second end panel 26 thus cooperate with central panel 22 to provide a double-wall construction at the end areas of carrier 12. It should be understood that, while the panels are shown and described as being secured together using an adhesive, any other satisfactory securement method, such as, e.g. staples or other mechanical fasteners, may be employed.

When second end panel 26 is folded inwardly at fold or crease line 34, the cut-outs or notches 42 in the side edges of brace member mounting panel 28 overlie and are aligned with the cut-outs or notches 40 in the side edges of central panel 22. Brace member mounting panel 28 is then folded at fold or crease line 36 so that it projects outwardly at an angle relative to the plane of central panel 22. Fold or crease line 36 thus forms a pivot or hinge connection of brace member mounting panel 28 to central panel 22. When brace member mounting panel 28 is folded at fold or crease line 36, an inner portion of each cut-out or notch 42 remains in overlying, aligned relationship with a portion of the respective cut-out or notch 40 in central panel 22. The outer portion of each cut-out or notch 42, located outwardly of the fold or crease line 36, is positioned along with brace member mounting panel 28.

Either before or after the end panels 24, 26 are folded inwardly and secured to the central panel 22, the end reinforcing members 14, 16 may be secured to the end panels 24, 26, respectively. The end reinforcing members 14, 16 may be secured to the respective end panels 24, 26 in any satisfactory manner, such as using an adhesive, staples, or other non-mechanical or mechanical fastening means as desired. It is understood, however, that end reinforcing members 14, 16 need not necessarily be secured to the carrier 12 but may be used separately while still forming a part of the brace assembly 10.

Similarly, intermediate reinforcing member 18 is secured to brace member mounting panel 28 in any satisfactory manner, such as using an adhesive, staples, or other non-mechanical or mechanical fastening means as desired. Brace member 18 may be secured to brace member mounting panel 28 either before or after the end panels 24, 26 are folded relative to the central panel 22.

Figure 2:
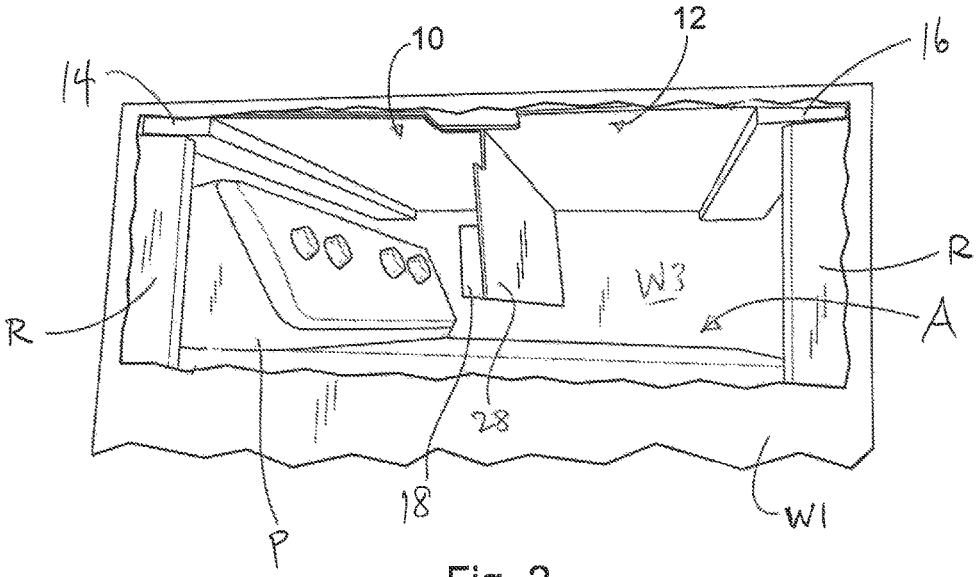
FIG. 2 is a partial perspective view illustrating an upper area of the container, appliance and lateral brace assembly as in FIG. 1, with portions broken away.

As noted above, when the second end panel 26 is folded inwardly at fold line or crease 34 and adhesive strip 38 is secured to central panel 22, cut-outs 42 overlie cut-outs 40. Brace member mounting panel 28 is then folded at fold line or crease 36 so as to pivot brace member mounting panel 28 away from central panel 22, as shown in FIGS. 1-3. Representatively, brace member mounting panel 28 may be pivoted to a position in which it is oriented generally perpendicularly to central panel 22, although it is understood that brace member mounting panel 28 may be moved to any non-parallel position relative to central panel 22 as desired. In this manner, when brace member mounting panel 28 is moved away from central panel 22, intermediate brace member 18 is at a location vertically spaced from the plane of central panel 22.

In use, brace assembly 10 is employed by positioning it at the upper end of container C after appliance A and corner reinforcing members R are placed into the interior of container C. As noted above, end reinforcing members 14 and 16 are positioned so as to span between and rest on top of opposite pairs of corner reinforcing members R. Brace member mounting panel 28 is then positioned so as to depend from central panel 22 of brace assembly 10, so that intermediate brace member 18 is located below central panel 22 and above the top surface of appliance A. Cut-outs 40 and 42 provide access for a user to brace member mounting panel 28 so that the user can ensure that brace member mounting panel 28, and therefore intermediate brace member 18, are in a desired position relative to appliance A and/or located at a desired angle relative to central panel 22 after brace assembly 10 has been placed over appliance A and on corner reinforcing members R.

End reinforcing members 14, 16 and intermediate reinforcing member 18 provide lateral reinforcement for the upper regions of container C. End reinforcing members 14, 16 reinforce the upper corners of container C against lateral forces, and intermediate reinforcing member 18 reinforces the central, upper region of container C between end reinforcing members 14, 16 and below the top of container C. This construction helps ensure that container C can withstand lateral forces that may be applied during shipping and handling, such as in the event container C is subjected to lateral clamping forces, in order to ensure protection of the side surfaces of appliance A.

While the invention as shown and described contemplates separate reinforcing members that are secured to various areas of the panels of brace assembly 10, it is also contemplated that the brace members may be extensions of the panels to which they are mounted and that are folded upon themselves numerous times to create rigid structures that are capable of withstanding compressive forces.

Also, as noted above it is also contemplated that the end reinforcing members 14, 16 may be coupled to or rest on the corner reinforcing members R separately as opposed to being a part of the lateral brace assembly 10. That is, the lateral brace assembly 10 may be placed on top of the end reinforcing members 14, 16, which have been coupled to or positioned on the adjacent corner reinforcing members R.

It should be understood that the above description, while indicating representative embodiments of the present invention, is given by way of illustration and not of limitation. Many changes and modifications may be made within the scope of the present invention without departing from the spirit thereof, and the invention includes all such modifications.

Various additions, modifications, and rearrangements are contemplated as being within the scope of the following claims, which particularly point out and distinctly claim the subject matter regarding as the invention, and it is intended that the following claims cover all such additions, modifications, and rearrangements.

We claim:

1. A container for an article comprising:

a series of walls that cooperate to define an interior of the container, wherein the walls define an open top that provides access to the interior of the container; and a brace arrangement positioned below the open top defined by the walls of the container, wherein the brace arrangement includes a main carrier panel positioned across at least a portion of the open top, a brace member mounting panel that includes an upper end interconnected with the main carrier panel, wherein the brace member mounting panel is suspended from the main carrier panel and is positioned within the interior of the container below the main carrier panel, and a brace member secured to the brace member mounting panel, wherein the brace member defines opposite ends, each of which is located adjacent one of a pair of opposite sidewalls of the container.

2. The container of claim 1, wherein a series of upright members are positioned within the interior of the container, and wherein the main carrier panel is engaged with and supported by the series of upright members.

3. The container of claim 1, wherein the upper end of the brace member mounting panel is hingedly interconnected with the main carrier panel.

4. The container of claim 3, wherein the main carrier panel is formed from a blank of material that includes a central panel section and a pair of end panels that are folded onto and secured to the central panel section, and wherein the brace member mounting panel is hingedly secured to one of the end panels.

5. The container of claim 4, further comprising a pair of end reinforcing members located one on either side of the brace member.

6. The container of claim 5, wherein the end reinforcing members are secured to the main carrier panel.

7. The container of claim 3, wherein the main carrier panel includes one or more access openings that provide access to the brace member mounting panel when the brace arrangement is positioned within the interior of the container.

8. A brace arrangement for a container, comprising:

a carrier member that includes a main panel defining a pair of ends;

a pair of end brace members, wherein each end brace member is secured to the main panel at one of the ends of the main panel; and an intermediate brace member interconnected with the main panel between the pair of end brace members, wherein the intermediate brace member is secured to a mounting panel defining an inner end and an outer end, wherein the inner end of the mounting panel is hingedly secured to the main panel, and wherein the intermediate brace member is secured to the mounting panel at a location outwardly of the inner end of the mounting panel, wherein the mounting panel is configured to space the intermediate brace member from the main panel a greater distance than the pair of end brace members.

9. The brace arrangement of claim 8, wherein the main panel includes a central panel section and a pair of end panel sections that are folded onto and secured to the main panel section, wherein each end brace member is secured to one of the end panel sections, and wherein the brace member mounting panel is hingedly connected to one of the end panel sections.

* * * * *